US008725384B2

(12) United States Patent
Krull et al.

(10) Patent No.: US 8,725,384 B2
(45) Date of Patent: May 13, 2014

(54) DETECTION SYSTEM AND METHOD TO DETECT FLAME HOLDING EVENT

(75) Inventors: Anthony Wayne Krull, Anderson, SC (US); Gilbert Otto Kraemer, Greer, SC (US)

(73) Assignee: General Electic Company, Schenectady, NY (US)

( * ) Notice: Subject to any disclaimer, the term of this patent is extended or adjusted under 35 U.S.C. 154(b) by 163 days.

(21) Appl. No.: 13/370,963

(22) Filed: Feb. 10, 2012

(65) Prior Publication Data

US 2013/0211690 A1 Aug. 15, 2013

(51) Int. Cl.
*F02C 7/00* (2006.01)
*F23N 5/24* (2006.01)

(52) U.S. Cl.
CPC ..... *F23N 5/24* (2013.01); *F23N 2025/04* (2013.01); *F23N 2041/20* (2013.01)
USPC ..... 701/100; 60/39.091; 60/779

(58) Field of Classification Search
USPC ..... 701/100; 60/39.091, 39.11, 39.24, 779
See application file for complete search history.

(56) References Cited

U.S. PATENT DOCUMENTS

| | | | | |
|---|---|---|---|---|
| 4,744,670 | A * | 5/1988 | Janssen | 374/144 |
| 6,253,554 | B1 | 7/2001 | Kobayashi et al. | |
| 6,792,762 | B1 | 9/2004 | Yamanaka et al. | |
| 2007/0119147 | A1 * | 5/2007 | Cornwell et al. | 60/39.281 |
| 2008/0134684 | A1 * | 6/2008 | Umeh et al. | 60/772 |
| 2010/0170217 | A1 | 7/2010 | Kraemer et al. | |
| 2010/0180674 | A1 | 7/2010 | Ziminsky et al. | |
| 2010/0263350 | A1 | 10/2010 | Liu et al. | |

* cited by examiner

*Primary Examiner* — Marthe Marc-Coleman
(74) *Attorney, Agent, or Firm* — Cantor Colburn LLP

(57) ABSTRACT

A turbine to detect a flame holding event includes a combustion section to receive a fluid from a compressor, to heat the fluid by combusting a fuel to generate heat, and to output the heated fluid to a turbine section. The combustion section includes a combustor having a combustion chamber in which the fuel is combusted, and the combustion section having a sensor to sense a static pressure within the combustion chamber. A combustion control device detects a flame holding event in the combustion chamber based only on the sensed static pressure.

20 Claims, 5 Drawing Sheets

DETECTION SYSTEM AND METHOD TO DETECT FLAME HOLDING EVENT

BACKGROUND OF THE INVENTION

The subject matter disclosed herein relates to a turbine and in particular to the detection of a flame holding event in the turbine.

A turbine includes a combustion section to heat a flow of fluid through the turbine. The combustion section includes combustion chambers in which fuel is ignited to generate the heat that heats the fluid flowing through the turbine. However, if a flame forms on one or more surfaces of the combustion chamber in a flame holding event, the combustion chamber may be damaged.

BRIEF DESCRIPTION OF THE INVENTION

According to one aspect of the invention, a turbine to detect a flame holding event comprises a combustion section to receive a fluid from a compressor, to heat the fluid by combusting a fuel to generate heat, and to output the heated fluid to a turbine section, the combustion section including a combustor having a combustion chamber in which the fuel is combusted, and the combustion section having a sensor to sense a static pressure within the combustion chamber. The turbine further comprises a combustion control device to detect a flame holding event in the combustion chamber based on a comparison of the sensed static pressure with a predetermined threshold value.

According to another aspect of the invention, a power generating system to detect a flame holding event comprises a turbine including a combustion section to combust a fuel to generate heat to heat a fluid, and a turbine section to generate power with the heated fluid, the combustion section including a sensor; and a combustion control device to receive a detected static pressure of the combustion section from the sensor and to detect a flame holding event based on a comparison of the detected static pressure with a first predetermined threshold value.

According to yet another aspect of the invention, a method of detecting a flame holding event in a combustion chamber comprises detecting a first absolute pressure in the combustion chamber; calculating a difference between the first absolute pressure and a previously-detected second absolute pressure; and comparing the difference with a predetermined threshold to detect the flame holding event.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
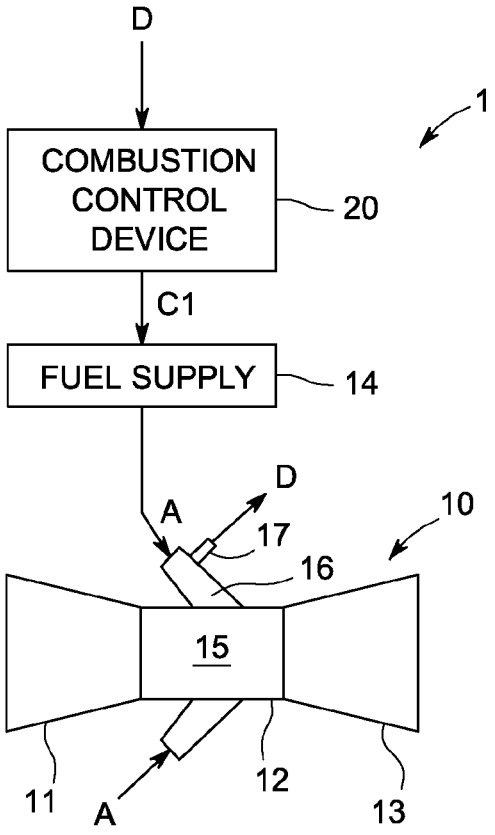
FIG. 1 illustrates a turbine according to an embodiment of the invention.

FIG. 1 illustrates a turbine system 1 according to an embodiment of the invention. The turbine system 1 includes a turbine 10 and a combustion control device 20. According to an alternative embodiment, the combustion control device 20 is connected to, mounted to, or part of the turbine 10. The turbine 10 includes a compressor 11, combustion section 12, and turbine section 13. The compressor 11 intakes and compresses a fluid, the combustion section 12 heats the fluid, and the turbine section 13 generates work with the heated fluid. According to the present embodiment, the fluid is air, and the work is rotating a shaft, which is used to generate power.

The combustion section 12 includes a main body cavity 15 through which the air passes from the compressor 11 to the turbine section 13. The combustion section 12 also includes a combustor 16. The turbine 10 includes a fuel supply 14, which supplies fuel to the combustor 16, as indicated by the reference letter A in FIG. 1. According to some embodiments, air is mixed with the fuel prior to insertion into the combustor 16. In yet other embodiments, additional fluids are mixed with the fuel and/or the air to combust in the combustor 16.

The combustor 16 includes a sensor 17 to sense one or more characteristics within the combustor 16, such as a static pressure, a temperature, and a differential pressure. A detection signal or data D corresponding to the detected characteristics in the combustor 16 is transmitted to the combustion control device 20. The combustion control device 20 determines whether a flame holding event has occurred based on the detected characteristics.

Figure 2:
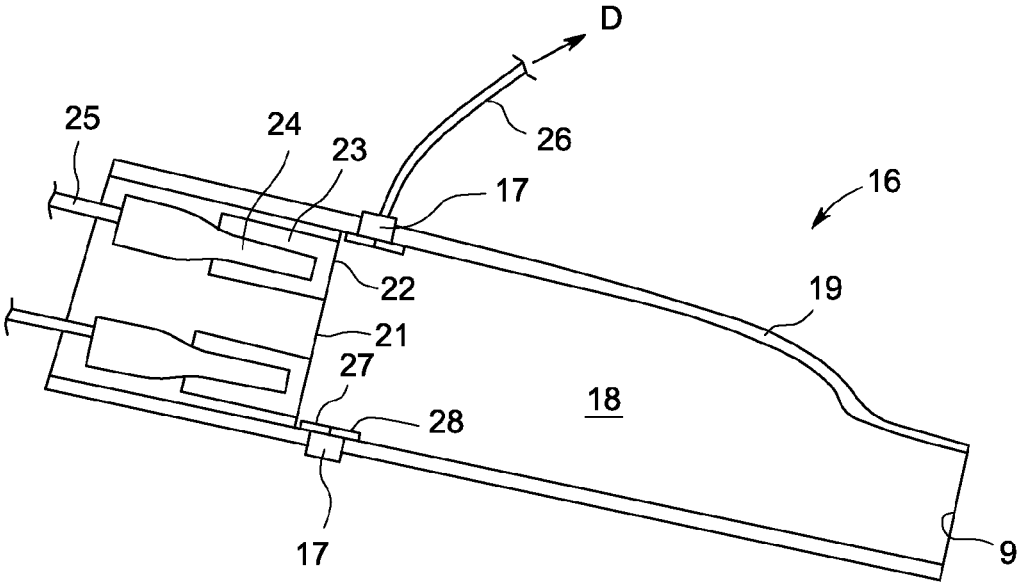
FIGS. 2 and 3 illustrate a combustor of the turbine.
Figure 3:
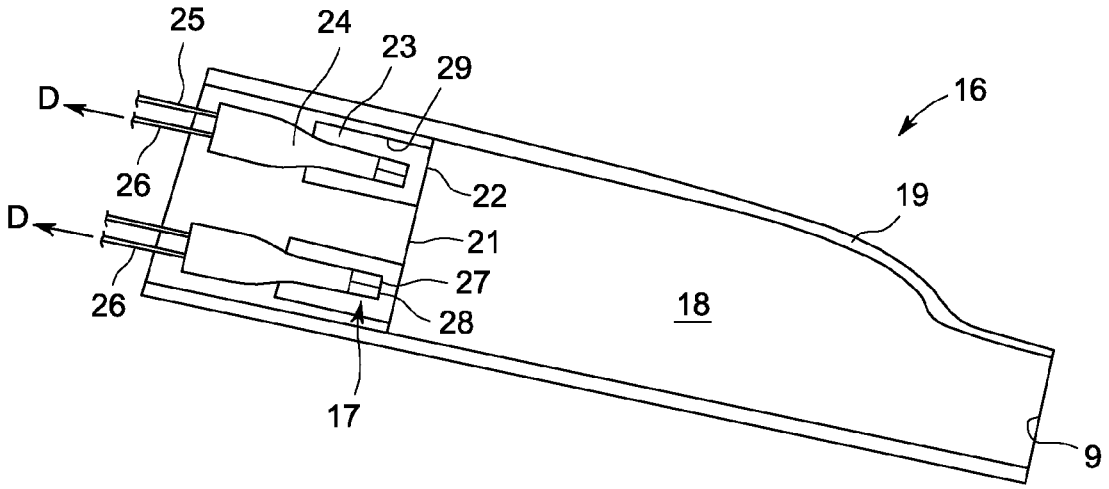

FIGS. 2 and 3 illustrate the combustor 16 in further detail. The combustor 16 includes a casing 19 that defines a combustion chamber 18. One end 9 of the combustion chamber 18 opens to the main body cavity 15, and the other end 21 corresponds to nozzles 24 which provide fuel to the combustion chamber 18. The nozzles 24 are housed within cavities 23 which are connected to the combustion chamber 18 via openings 22 at the end 21 of the combustion chamber 18. Hoses or lines 25 are connected to the nozzles 24 to supply fuel to the nozzles.

In the embodiment illustrated in FIG. 2, a sensor 17 breaches the casing 19, and the sensing end of the sensor 17 is located within the combustion chamber 18. A communication line 26 transmits data D to the combustion control device 20. The sensor 17 includes a static pressure sensor 27 and a temperature sensor 28. According to alternative embodiments, the sensor 17 includes only a static pressure sensor 27 to provide a simple and inexpensive means of detecting a flame holding event. In yet other embodiments, the sensor 17 also includes a differential pressure sensor.

FIG. 2 illustrates a cross-section view of the combustor 16 in which two sensors 17 are illustrated. A number of sensors 17 in the combustion chamber 18 may be only one, or may include a number greater than two. For example, in one embodiment, at least one sensor is located adjacent to each opening 22 to provide data regarding the location of a particular nozzle 24 having a flame holding event.

A detection portion of the sensor 17 is located within the combustion chamber 18 to detect one or more of the absolute pressure, the differential pressure, and the temperature within the combustion chamber 18. According to the embodiments of the present invention, the sensor 17 includes at least an absolute pressure sensor 27. In the embodiments illustrated in FIGS. 2 and 3, the sensor 17 includes an absolute pressure sensor 27 and a temperature sensor 28. The combustion control device 20 receives the data D regarding temperature and absolute pressure within the combustion chamber 18 and determines whether a flame holding event has occurred based on the received data D. The temperature data is used to verify the absolute pressure data, and may further be used to help isolate a particular nozzle 24 that is affected by the flame holding event.

FIG. 3 illustrates an embodiment of the invention in which the sensors 17 are located on the nozzles 24. According to alternative embodiments, the sensors 17 are located on sides of the nozzles 24 or on side walls 29 of the cavities 23. Since the sensors 17 are located within the cavities, the sensors 17 do not breach the casing 19. The communication lines 26 extend from the nozzles 24 to provide data D from the sensors 17 to the combustion control device 20. In alternative embodiment, the sensors 17 include a power source and wireless antenna to transmit sensed data D wirelessly to the combustion control device 20.

Referring to FIGS. 1 through 3, the sensor 27 outputs the detection signal D corresponding to the detected absolute pressure within the combustion chamber 18 to the combustion control device 20. The combustion control device 20 determines whether the detected absolute pressure corresponds to a flame holding event. If it is determined that the detected absolute pressure corresponds to a flame holding event, the combustion control device controls the fuel supply 14 to control the flow of fuel into the combustion chamber 18 to correct the flame holding event.

In another embodiment, the detection signal D includes data regarding both the absolute pressure and the temperature within the combustion chamber 18, and the combustion control device 20 detects whether the flame holding event has occurred by analyzing both the absolute pressure and temperature data. In addition, the combined absolute pressure and temperature data provides additional information regarding the location of the flame holding event to allow the combustion control device 20 to adjust the fuel output from particular nozzles 24 while leaving other nozzles 24 unchanged.

Figure 4:
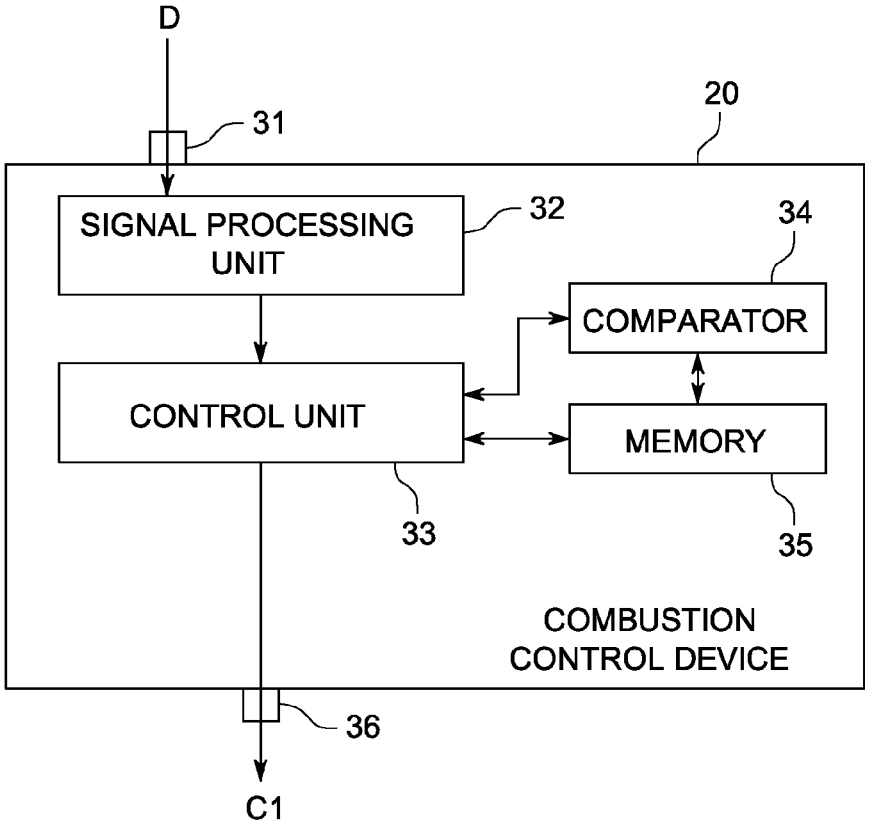
FIG. 4 illustrates a combustion control device.

As illustrated in FIG. 4, the combustion control device 20 includes a signal processing unit 32, a control unit 33, a comparator 34, and memory 35. The signal processing unit 32 receives the detection signal D from the sensor 17 via the input terminal 31 and converts the detection signal D into a format for digital processing. In one embodiment, the signal processing unit is an A/D converter. A predetermined characteristic is stored in memory 35. Examples of the predetermined characteristic include a previously-measured pressure, a previously-measured temperature, a threshold pressure, and a threshold temperature.

To detect the flame holding event, the control unit 33 obtains the presently-detected absolute pressure from the data D and a previously-stored absolute pressure from memory 35 and compares the presently-detected pressure with the previously-stored pressure. The previously-stored pressure corresponds to a pressure from a predetermined time interval, such as one second. In other words, the comparator 24 compares a presently-detected pressure with the pressure detected one second previously and stored in memory 35. If the difference between the pressures exceeds a predetermined threshold stored in memory 35, the control unit 33 determines that a flame holding event has occurred, and adjusts the control signal C1 to adjust the output of the nozzles 24. In this embodiment, the flame holding event is detected by detecting a sudden and pronounced static pressure increase.

In the above embodiment, a static pressure sensor 27 alone is used by the combustion control device 20 to detect a flame holding event in the combustion chamber 18. The use of the static pressure sensor 27 provides a simple and cost-effective detection system of the flame holding event.

In another embodiment, the detection signal D includes data regarding the absolute pressure and the temperature. The control unit 33 performs the analysis of the presently-detected absolute pressure and the previously-detected absolute pressure, as discussed above, then the control unit 33 analyzes the temperature data to confirm the detected flame holding event, or to isolate one or more nozzles 24 as having the flame holding event. Analyzing the temperature data includes comparing the temperature data to predetermined threshold temperature data stored in memory 35 or to previously-detected temperature data stored in memory 35. According to this embodiment, if both the static pressure sensor 27 and the temperature sensor 28 detect characteristics consistent with a flame holding event, the control unit 33 adjusts the control signal C1 to correct the flame holding event.

According to another embodiment, the comparator 34 compares the presently-detected static pressure data to a threshold static pressure data stored in memory 35. The threshold static pressure data is a pre-set value that is set according to the operating specifications of the combustor 16. For example, the combustor 16 is designed to operate within a predetermined range of static pressures, and the threshold static pressure data corresponds to an upper limit of the range.

The control unit 33 includes at least a processor, and further includes supporting logic and memory. Although FIG. 4 illustrates the signal processing unit 32 and comparator 34 as being separate components from the control unit 33, according to alternative embodiments, the signal processing unit and comparator are operations executed by the processor of the control unit 33 based on programs stored in memory, such as memory 35 or cache memory or other memory of the control unit 33. Alternatively, the signal processing unit 32 and comparator 34 are part of the control unit 33, which is a PCB system including circuitry of the signal processing unit 32 and the comparator 34, or an integrated circuit.

Figure 5:
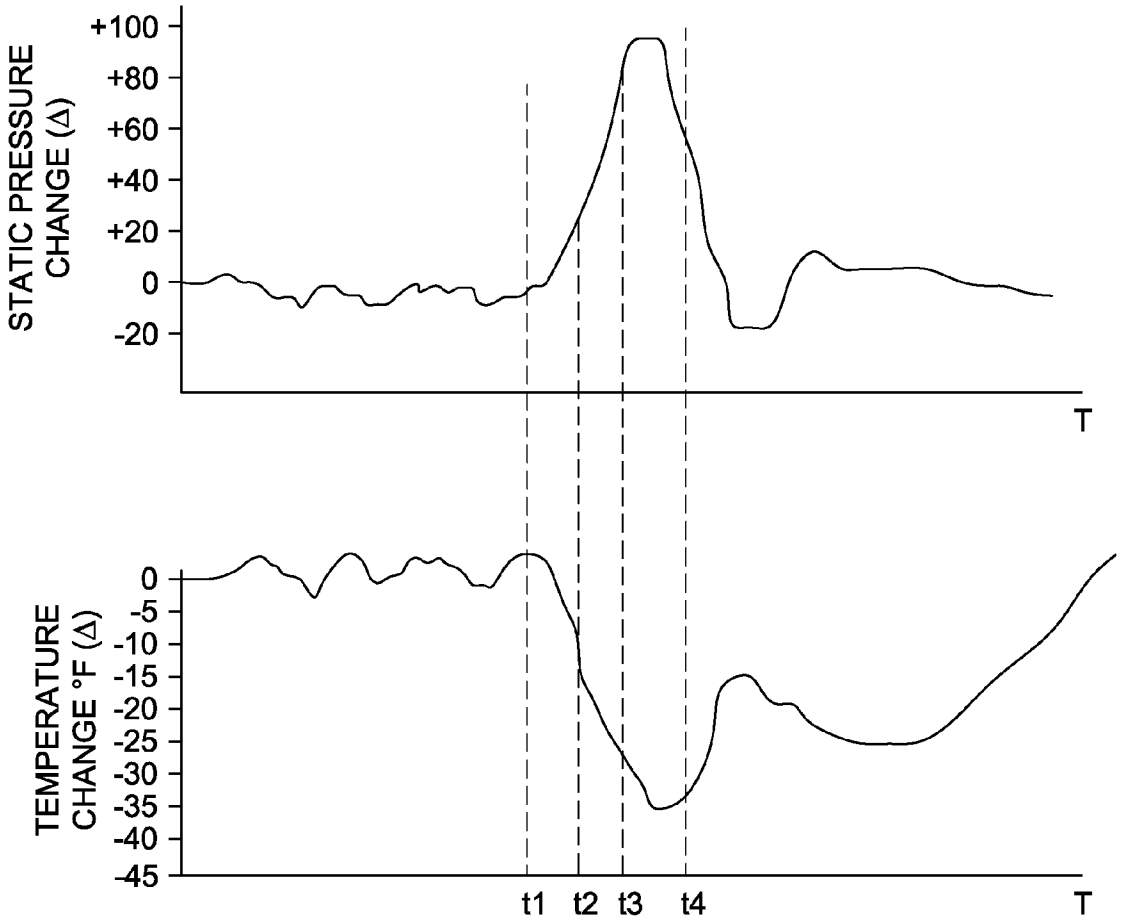
FIG. 5 is a chart of a detected pressure over time.

FIG. 5 illustrates an example of the detected static pressure and temperature corresponding to the detection signal D within a combustion chamber 18. The characteristics are detected at times t1, t2, t3, and t4, which correspond to seconds in the present embodiment. However, in alternative embodiments, the static pressure is detected at other increments of time, including at increments less than one second. In the graphs of FIG. 5, the vertical axes represent a change in static pressure from a base pressure in PSI, and a change in temperature from a base temperature in degrees Fahrenheit, respectively. The base pressure and values correspond to an average normal operating pressure and temperature.

At time t1, before a flame holding event is detected, the detected pressure and temperature are at base levels, shown as 0 (referring to a change from the base level, and not an absolute value of the pressure and temperature) in the graphs of FIG. 5. At time t2, the pressure has increased by 20 PSI from the base pressure, but the temperature has decreased by 5 degrees Fahrenheit from the base temperature. At time t3, the pressure has increased approximately 80 PSI from the base pressure, but the temperature has increased approximately 30 degrees from the base temperature. At time t4, the pressure has increased approximately 50 PSI from the base pressure, or decreased approximately 30 PSI from the reading at time t3. The temperature has decreased by approximately 35 degrees Fahrenheit from the base temperature.

When considering only the static pressure, the combustion control device 20 compares the pressure at time t2 with the pressure at time t1. If the difference (approximately 20 PSI) is greater than a predetermined threshold, the combustion control device 20 determines that a flame holding event has occurred and adjusts the control signal C1 to correct the flame holding event. If the difference is less than the predetermined threshold, the combustion control device 20 receives the next detection signal D at time t3 and compares the static pressure with the static pressure of time t2. If the difference (approximately 60 PSI) is greater than the predetermined threshold, the combustion control device 20 determines that a flame holding event has occurred and adjusts the control signal C1 to correct the flame holding event.

According to another embodiment, the static pressure values are compared with a predetermined static pressure value threshold instead of a previously-detected static pressure value. For example, if the static pressure threshold is set at +30 PSI greater than the base PSI level, then the combustion control device 20 would determine that the flame holding event had occurred as soon as the detected PSI level exceeded +30 PSI relative to the base value.

According to yet another embodiment, the detected temperature is analyzed to verify whether the flame holding event has occurred. Referring to the temperature values detected in FIG. 5, the combustion control device 20 may determine that since the temperature sensor 28 detected a decrease in temperature while the pressure increased, the flame holding event occurred at a nozzle 24 that was not adjacent to the sensor 17. If an increase in temperature were detected, the combustion control device 20 may determine that the flame holding event occurred at a nozzle 24 adjacent to the sensor 17. And if no significant temperature change were detected, the combustion control device 20 may determine that a change in pressure is due to an event other than a flame holding event. Consequently, the temperature data is combined with the static pressure data to verify a flame holding event and to isolate nozzles 24 associated with the flame holding event.

Figure 6:
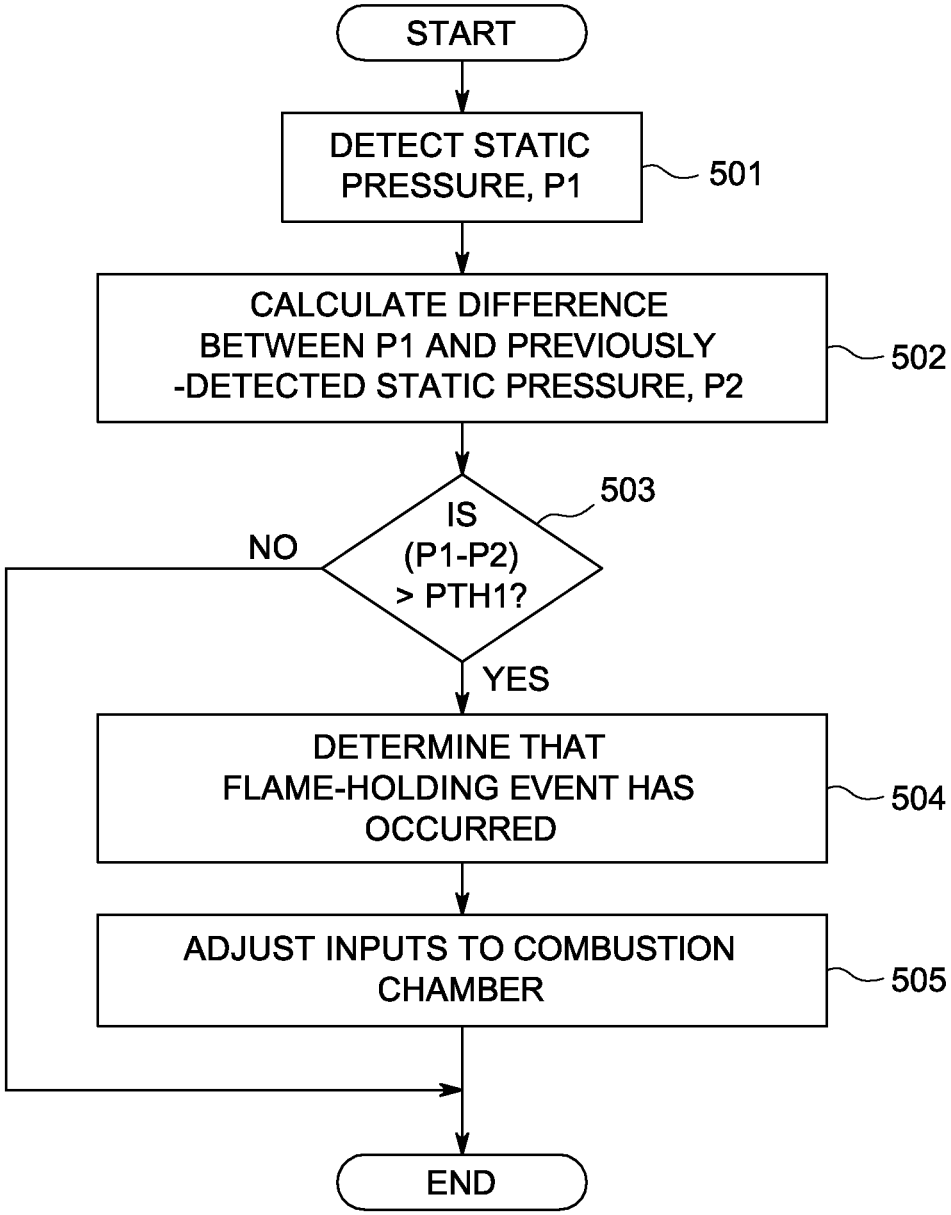
FIG. 6 is a flow chart of a method to detect a flame holding event.

FIG. 6 illustrates a method of detecting a flame holding event. In operation 501 a static pressure P1 is detected. The sensor 17 of the combustor 16 detects the static pressure within the combustion chamber 18 and transmits a detection signal D corresponding to the detected static pressure P1 to the combustion control device 20.

In operation 502, a difference between the detected static pressure P1 and a previously-detected static pressure P2 is calculated. The control unit 33 of the combustion control device 20 receives each of the detected static pressure P1 and a previously-detected static pressure P2 stored in memory 35 to calculate the difference.

In operation 503, the difference is compared to a predetermined threshold difference PTH1. The comparator 34 of the combustion control device 20 receives the difference from the control unit 33 and receives the predetermined threshold difference PTH1 from memory 35. If it is determined that the calculated difference is not greater than the predetermined threshold difference PTH1, the operation ends, and a next static pressure is detected.

However, if it is determined that the calculated pressure difference is greater than the predetermined threshold difference PTH1, it is determined in operation 504 that a flame holding event has occurred, or is occurring. In operation 505, inputs to a combustion chamber are adjusted to correct the flame holding event. The control unit 33 adjusts the values of one or more of the control signals C1, C2, C3, and C4 to control one or more of the fuel supply 14, the air supply 15, and the fuel distribution to one or more nozzles 24 to adjust an input of fuel and/or air into the combustion chamber 18.

According to the above-described embodiments, a flame holding event is detected in a combustion chamber using a simple and cost-effective hardware configuration using only a sensor in the combustion chamber. However, while embodiments of the invention are described with respect to a flame holding event, any event that is detected by a change in pressure in the combustion chamber may be detected according to the above-described structures.

Figure 7:
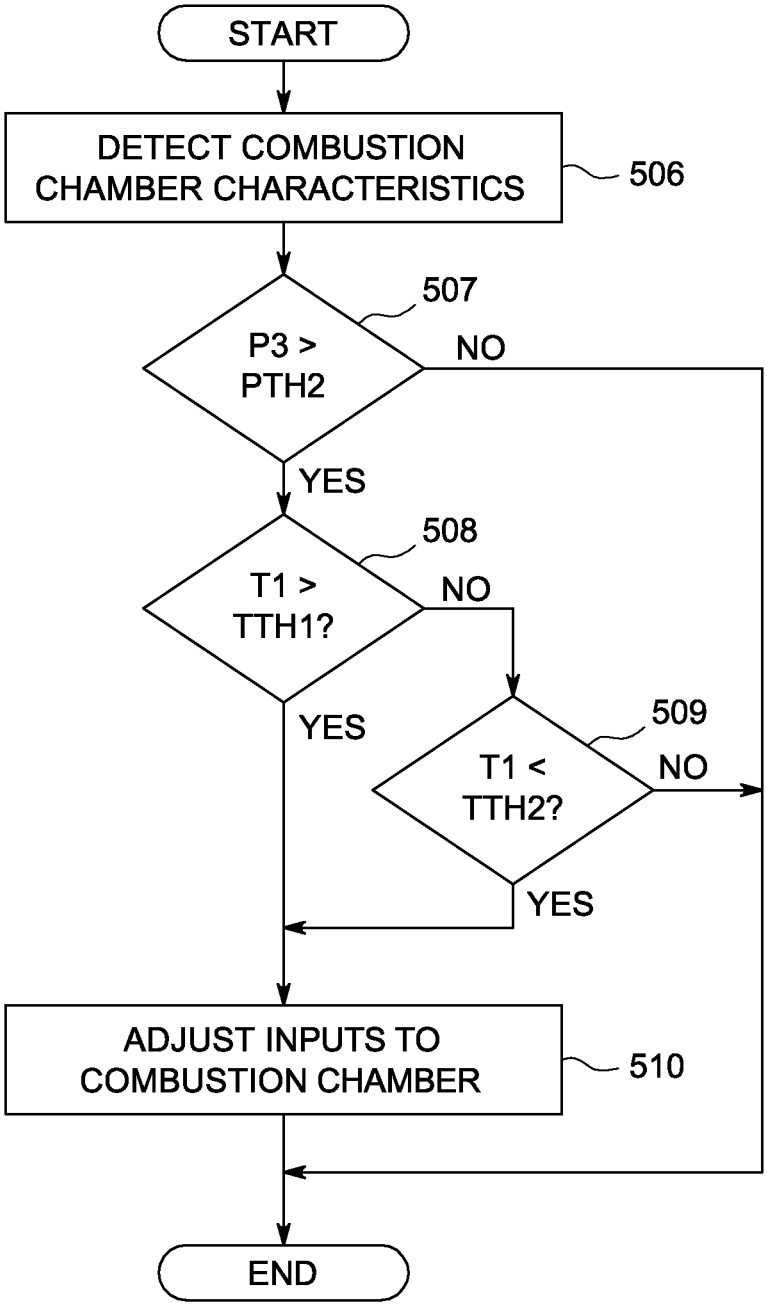
FIG. 7 is a flow chart of a method to detect a flame holding event according to another embodiment.

FIG. 7 illustrates a flow diagram of a method to detect a flame holding event according to another embodiment. In operation 506, characteristics of the combustion chamber 16 are detected. The characteristics include at least the static pressure in the combustion chamber 16, and may further include the temperature and the differential pressure, for example. In the embodiment illustrated in FIG. 7, the combustion chamber characteristics include the static pressure and the temperature.

The detected static pressure P3 is compared to a threshold static pressure PTH2. According to different embodiments, the detected static pressure P3 corresponds to either the presently-detected pressure or to a difference between the presently-detected pressure and a previously-detected static pressure, as described in FIG. 6. The detected static pressure P3 is compared to a threshold pressure PTH2 in operation 507. According to alternative embodiments, the threshold pressure PTH2 is either a threshold value corresponding to a difference in pressure over a predetermined period of time, or to a predetermined pressure value.

If the detected static pressure P3 is greater than the threshold pressure PTH2, it is determined in operation 508 whether the detected temperature T1 is greater than a first threshold temperature TTH1. If so, it is determined that a flame holding event has occurred, and at least the fuel input to the combustion chamber 16 is adjusted in operation 510 to correct the flame holding event.

If the detected temperature T1 is not greater than the first threshold temperature TTH1, it is determined in operation 509 whether the detected temperature T1 is less than a second threshold temperature TTH2 that is less than the first threshold temperature TTH1. If so, it is determined that a flame holding event has occurred, potentially at a nozzle 24 farther away from the sensor 17, and the inputs to the combustion chamber 16 are adjusted in operation 510 to correct the flame holding event. If it is determined that the detected temperature T1 is not less than the second threshold temperature TTH2, then it may be determined that the change in pressure is not caused by a flame holding event, and the inputs to the combustion chamber 16 are not adjusted.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A flame holding event detection system of a turbine, comprising:

a combustion section to receive a fluid from a compressor, to heat the fluid by combusting a fuel to generate heat, and to output the heated fluid to a turbine section, the combustion section including a combustor having a combustion chamber in which the fuel is combusted, and the combustion section having a sensor to sense a static pressure within the combustion chamber; and a combustion control device to detect a flame holding event in the combustion chamber based on a comparison of the sensed static pressure with a predetermined threshold value.

2. The flame holding event detection system of claim 1, wherein the combustor includes a nozzle, and the combustion control device controls a supply of fuel to the nozzle based on the sensed static pressure.

3. The flame holding event detection system of claim 1, wherein the sensor is located inside the combustion chamber.

4. The flame holding event detection system of claim 1, wherein the combustion control device calculates a pressure difference between the sensed static pressure and a previously-sensed static pressure, and compares the pressure difference to the predetermined threshold value to detect the flame holding event.

5. The flame holding event detection system of claim 1, wherein the predetermined threshold value is a predetermined static pressure level.

6. The flame holding event detection system of claim 1, wherein the sensor further senses a temperature within the combustion chamber, and the combustion control device detects the flame holding event in the combustion chamber based on the sensed static pressure and the sensed temperature.

7. The flame holding event detection system of claim 6, wherein the combustion control device further determines a location in the combustion chamber of the flame holding event based on the sensed static pressure and the sensed temperature.

8. The flame holding event detection system of claim 1, wherein the combustion section includes a plurality of sensors to correspond to a plurality of nozzles, and the combustor includes a plurality of cavities in which the plurality of nozzles and the plurality of sensors are located, the plurality of cavities having an end open to the combustion chamber.

9. A power generating system to detect a flame holding event, comprising:

a turbine including a combustion section to combust a fuel to generate heat to heat a fluid, and a turbine section to generate power with the heated fluid, the combustion section including a sensor; and a combustion control device to receive a detected static pressure of the combustion section from the sensor and to detect a flame holding event based on a comparison of the detected static pressure with a first predetermined threshold value.

10. The power generating system of claim 9, wherein the combustion control device adjusts a supply of the fuel into the combustion section when the flame holding event is detected.

11. The power generating system of claim 9, wherein the combustion control device calculates a pressure difference by comparing the detected static pressure to a previously-detected static pressure, and the combustion control device detects the flame holding event by comparing the pressure difference to the first predetermined threshold value.

12. The power generating system of claim 9, wherein the combustion section includes a combustor having a plurality of nozzles, and the sensor includes a plurality of sensors corresponding to the plurality of nozzles.

13. The power generating system of claim 12, wherein the combustor includes a plurality of cavities in which the plurality of nozzles and the plurality of sensors are located.

14. The power generating system of claim 9, wherein the sensor further senses a temperature within the combustion section, and the combustion control device detects the flame holding event based on the comparison of the sensed static pressure with the first predetermined threshold value and upon a comparison of the sensed temperature with a second predetermined threshold value.

15. A method of detecting a flame holding event in a combustion chamber, the method comprising:

detecting, by a static pressure sensor, a first absolute pressure in the combustion chamber;

calculating a pressure difference between the first absolute pressure and a previously-detected second absolute pressure in the combustion chamber; and comparing the pressure difference with a predetermined threshold to detect the flame holding event.

16. The method of claim 15, wherein the predetermined threshold is an increase in absolute pressure of a predetermined magnitude over a predetermined period of time.

17. The method of claim 15, further comprising:

after detecting the flame holding event, adjusting a fuel input to the combustion chamber to correct the flame holding event.

18. The method of claim 15, further comprising:

detecting a temperature in the combustion chamber, and detecting the flame holding event based on the detected temperature and the comparison of the pressure difference with the predetermined threshold.

19. The method of claim 18, wherein detecting the flame holding event based on the detected temperature and the comparison of the pressure difference with the predetermined threshold includes comparing the detected temperature to a first temperature threshold, and determining that the flame holding event is detected when the pressure difference is greater than the predetermined threshold and the detected temperature is greater than the first temperature threshold.

20. The method of claim 19, wherein detecting the flame holding event based on the detected temperature and the comparison of the pressure difference with the predetermined threshold includes comparing the detected temperature to a second temperature threshold less than the first temperature threshold, and determining that the flame holding event is detected when the pressure difference is greater than the predetermined threshold and the detected temperature is less than the second temperature threshold.

* * * * *